US011518017B2

(12) United States Patent
Steingruber

(10) Patent No.: US 11,518,017 B2
(45) Date of Patent: Dec. 6, 2022

(54) VIBRATION-DAMPED HAND-HELD POWER TOOL

(71) Applicant: Hilti Aktiengesellschaft, Schaan (LI)

(72) Inventor: Adrian Steingruber, Schwabmuenchen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/757,737

(22) PCT Filed: Nov. 21, 2018

(86) PCT No.: PCT/EP2018/082028
§ 371 (c)(1),
(2) Date: Apr. 20, 2020

(87) PCT Pub. No.: WO2019/120837
PCT Pub. Date: Jun. 27, 2019

(65) Prior Publication Data

US 2021/0187721 A1 Jun. 24, 2021

(30) Foreign Application Priority Data

Dec. 19, 2017 (EP) ..... 17208325

(51) Int. Cl.
*B25F 5/00* (2006.01)
*B25D 17/24* (2006.01)

(52) U.S. Cl.
CPC ..... *B25F 5/006* (2013.01); *B25D 17/24* (2013.01); *B25D 2250/371* (2013.01)

(58) Field of Classification Search
CPC .... B25F 5/006; B25D 17/24; B25D 2250/371
See application file for complete search history.

(56) References Cited

U.S. PATENT DOCUMENTS 2,454,818 A * 11/1948 Lucht ..... F41A 25/18 89/44.01
2,533,703 A * 12/1950 Wilhide ..... B25B 21/02 173/93.6

(Continued)

FOREIGN PATENT DOCUMENTS

DE 10334906 A1 2/2004
DE 202004013670 U1 11/2004

(Continued)

OTHER PUBLICATIONS https://blogs.solidworks.com/tech/2014/07/when-an-off-the-shelf-spring-just-wont-do-part-2.html, Attached as Solidwork.pdf, Jul. 2014.*

(Continued)

*Primary Examiner* — Robert F Long
*Assistant Examiner* — Eduardo R Ferrero
(74) *Attorney, Agent, or Firm* — Davidson, Davidson & Kappel, LLC

(57) ABSTRACT

An electric hand-held power tool (100), in particular a hammer drill or chipping hammer, having a percussion mechanism assembly (10), which vibrates along a vibration axis (A), and a handle assembly (20), which is vibrationally decoupled via an anti-vibration unit (30), wherein the anti-vibration unit (30) has a coil spring (35), oriented along the vibration axis (A), having a plurality of turns, wherein the coil spring (35) is in the form of a cylindrically progressive compression spring (36) having two stiffness regions (S1, S2) with different levels of stiffness.

16 Claims, 7 Drawing Sheets

(56) References Cited

U.S. PATENT DOCUMENTS 2,559,903 A * 7/1951 Sjolander ..... F16F 13/02 267/135
2,613,656 A * 10/1952 Leach ..... F01L 1/32 123/90.29
2,789,550 A * 4/1957 Black ..... F01L 3/10 123/90.65
3,141,660 A * 7/1964 Clarke ..... F16F 1/13 267/166
3,411,591 A * 11/1968 Roll ..... B25D 11/102 173/203
3,788,404 A * 1/1974 Koudelka ..... B25D 17/24 173/211
4,371,043 A * 2/1983 Kubokawa ..... B24B 23/02 173/162.2
4,420,141 A * 12/1983 Goloff ..... F16F 1/02 123/90.65
4,810,231 A * 3/1989 Weissenberger ..... F16F 1/043 192/203
5,522,466 A * 6/1996 Harada ..... B25D 17/043 173/162.2
5,697,456 A * 12/1997 Radle ..... B25D 17/043 173/162.2
6,375,171 B1 * 4/2002 Zimmermann ..... B25F 5/006 267/137
7,076,838 B2 * 7/2006 Meixner ..... B25D 17/043 16/430
7,270,320 B2 9/2007 Menzel et al.
7,320,369 B2 * 1/2008 Stirm ..... B25D 17/043 173/162.1
7,344,172 B1 * 3/2008 Bauman ..... B65G 7/12 294/175
7,568,682 B2 * 8/2009 Seelmann ..... E01F 8/0023 267/179
7,610,967 B2 * 11/2009 Fischer ..... B25D 17/043 173/162.2
7,837,434 B2 * 11/2010 Rabis ..... F04D 29/668 415/206
7,942,212 B2 * 5/2011 Zimmermann ..... B25F 5/006 173/171
8,225,913 B2 * 7/2012 Lee ..... F16F 9/067 188/267.2
8,511,658 B2 8/2013 Moessnang et al.
2004/0154813 A1 * 8/2004 Daubner ..... B25D 17/24 173/162.2
2006/0000438 A1 * 1/2006 Wolf ..... B27B 17/0033 123/198 E
2006/0144603 A1 * 7/2006 Arieh ..... B25D 17/24 173/109
2006/0144604 A1 * 7/2006 Soika ..... B25D 17/24 173/162.2
2007/0034396 A1 * 2/2007 Berger ..... B25F 5/006 173/162.2
2007/0277992 A1 12/2007 Fuenfer et al.
2008/0022817 A1 * 1/2008 Fischer ..... B25D 17/043 81/489
2008/0202785 A1 * 8/2008 Fischer ..... B25D 17/24 173/162.2
2008/0257676 A1 * 10/2008 Shaffer ..... F16D 1/108 192/25
2009/0095497 A1 * 4/2009 Zimmermann ..... B25F 5/006 173/162.2
2009/0188691 A1 * 7/2009 Hahn ..... B25D 17/24 173/162.2
2009/0283282 A1 * 11/2009 Zimmermann ..... B25D 17/043 173/162.2
2010/0206593 A1 * 8/2010 Schad ..... B25D 11/064 173/128
2012/0067605 A1 * 3/2012 Furusawa ..... B25D 17/24 173/162.2
2012/0160532 A1 * 6/2012 Kurzenberger ..... B27B 17/0033 173/162.2
2012/0279741 A1 * 11/2012 Schlesak ..... B25D 17/24 173/162.2
2013/0019955 A1 * 1/2013 Bagagli ..... F16K 15/12 137/12
2013/0112448 A1 * 5/2013 Profunser ..... B25B 21/02 173/93.5
2013/0192861 A1 * 8/2013 Braun ..... B25D 17/24 173/162.2
2014/0014190 A1 * 1/2014 Bagagli ..... F04B 39/1013 137/12
2015/0202762 A1 * 7/2015 Roberts ..... B25D 17/043 173/162.2
2015/0367492 A1 * 12/2015 Lindell ..... B25D 17/24 173/211
2016/0207188 A1 7/2016 Holubarsch et al.
2016/0243914 A1 * 8/2016 Dutton ..... F16F 1/44
2018/0250804 A1 * 9/2018 Hoche ..... B25F 5/006

FOREIGN PATENT DOCUMENTS

DE 10 2007 000 270 A1 11/2008
EP 2848370 A1 3/2015

OTHER PUBLICATIONS

All About Springs, Automated Industrial Motion, www.aimcoil.com (Year: 2019).*
All about Variable pitch Springs, Automated Industrial Motion, www.aimcoil.com (Year: 2019).*
International Search Report of PCT/EP2018/082028, dated Nov. 21, 2018.

* cited by examiner

36

| L [mm] | F [N] | tau [MPa] | s [mm] | R [N/mm] | tau/Rm |
|---|---|---|---|---|---|
| L0: 69.55 | | | | R0: 10.15 | |
| L1: 56.50 | F1: 132.5 | tauk1: 340 | s1: 13.05 | R1: 10.15 | 0.15 |
| L2: 42.50 | F2: 310.1 | tauk2: 797 | s2: 27.05 | R2: 15.99 | 0.34 |
| Lx: 48.55 | Fx: 213.42 | | sx: 21.00 | Rx: 15.99 | |
| Ln: 41.00 | Fn: 334.2 | tau n: 706 | sn: 28.56 | Rn: 15.99 | 0.37 |
| Lc: 36.67 | Fc: 403.3 | tau c: 851 | sc: 32.88 | Rc: 15.99 | 0.44 |

d = 2.8 mm
tau z: 1074
sh = 14

Dm = 18.2 ± 0.35 mm
n = 9.918 turns
nt = 13.10 turns
L0 = 69.55 mm
F1 = 132.5 ± 18 N
F2 = 310.1 ± 20.8 N
L = 752.4 mm
m = 34.29 g
Spring ends: closed and ground
Stress: dynamic
Treatment: spring shot peened
nue = 0.5
Manufacturing adjustment: L0,n and d at 2 predefined spring forces Messages
Warning : T<T1relax (80°)

L0 = nominal length of the unloaded spring
L1 = nominal length in the installed state - associated spring force F1
F1
L2 = nominal length in the actuated state - associated spring force F2
Ln = smallest permissible spring length - associated spring force Fn
Lc = block length
d = wire diameter
Dm = mean turn diameter of the spring
n = number of spring turns
nt = total number of turns

Fig.5

VIBRATION-DAMPED HAND-HELD POWER TOOL

The present invention relates to an electric hand-held power tool having a percussion mechanism assembly, which vibrates along a vibration axis, and a handle assembly, which is vibrationally decoupled via an anti-vibration unit, wherein the anti-vibration unit has a coil spring, oriented along the vibration axis, having a plurality of turns. A hand-held power tool of this kind is known for example from DE 10 2007 000 270 A1.

BACKGROUND

The object of the present invention is to provide a hand-held power tool, the vibration of which is ideally reduced in the range of medium to high contact pressures compared with the prior art, in particular without it being necessary to provide a relatively large spring travel in structural terms for this purpose.

SUMMARY OF THE INVENTION

It is an object of the present invention that the coil spring is in the form of a cylindrically progressive compression spring having two stiffness regions with different levels of stiffness.

In contrast to hand-held power tools known from the prior art, it is possible in this way to achieve a non-linear spring characteristic of the coil spring in a structurally simple and cost-effective way. In particular, the anti-vibration unit is free of a threaded mandrel on which the coil spring is at least locally screwed.

Since, according to the invention, the coil spring is in the form of a cylindrically progressive compression spring having two stiffness regions with different levels of stiffness, a comparatively simple adaptation of the stiffness profile is also possible, specifically merely by exchanging the coil spring itself.

In a particularly preferred configuration, the coil spring provided as a cylindrically progressive compression spring is configured in a progressive manner on one side. Preferably, the stiffness region with the higher stiffness sequentially follows the stiffness region with the low stiffness.

In a further preferred configuration, the coil spring provided as a cylindrically progressive compression spring is configured in a progressive manner on both sides, and has preferably a third stiffness region.

It has been found to be advantageous when the third stiffness region has the same stiffness as the stiffness region with the lower stiffness. Preferably, the stiffness region with the higher stiffness lies, along the vibration axis, between the stiffness regions with the respectively lower stiffness.

It has been found to be particularly advantageous when the stiffness regions with the respectively low stiffness exhibit the same length along the vibration axis. Alternatively or additionally, with the compression spring unloaded, the stiffness regions with the respectively lower stiffness may be shorter along the vibration axis than a length of the stiffness region with the higher stiffness.

Particularly preferably, the compression spring has a constant outside diameter. Preferably, the compression spring has, in the unloaded state, a length of between 65 and 75 mm. Particularly preferably, the compression spring 66 has an outside diameter of between 19 and 23 mm.

Further advantages will become apparent from the following description of the figures. The figures illustrate various exemplary embodiments of the present invention. The figures, the description and the claims contain numerous features in combination. A person skilled in the art will expediently also consider the features individually and combine them to produce expedient further combinations.

BRIEF DESCRIPTION OF THE DRAWINGS

Identical components and components of identical type are designated by identical reference signs in the figures, in which:

FIG. 5 shows different technical characteristics of the progressive compression spring in FIGS. 3 and 4;

DETAILED DESCRIPTION

Figure 1:
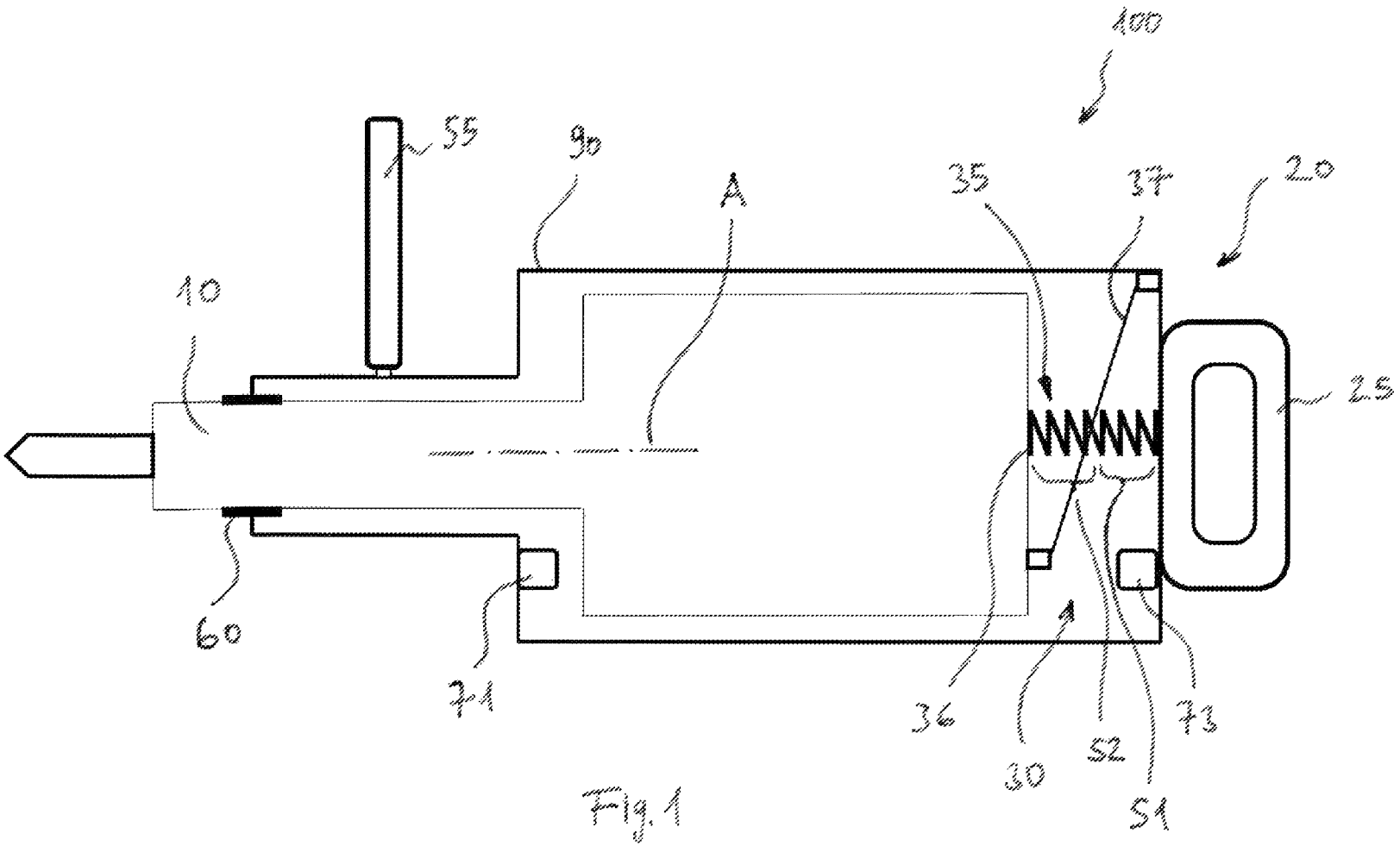
FIG. 1 shows a schematic illustration of a first preferred exemplary embodiment of an electric hand-held power tool.

A preferred exemplary embodiment of an electric hand-held power tool 100 is shown in FIG. 1. By way of example, the electric hand-held power tool 100 is provided in the form of a hammer drill. The hand-held power tool 100 has a percussion mechanism assembly 10, which vibrates along the vibration axis A. The percussion mechanism assembly 10 comprises an electric motor and a transmission, which are not illustrated here.

The electric hand-held power tool 100 also has a handle assembly 20, which is vibrationally decoupled via an anti-vibration unit 30. The anti-vibration unit 30 for its part has a coil spring 35, oriented along the vibration axis A, having a plurality of turns.

As can be gathered from FIG. 1, the percussion mechanism assembly 10 is mounted in a sliding manner via a sliding guide 60 in a housing unit 90 of the hand-held power tool 100.

The housing 90 can for its part be handled via a rear handle 25 and a front handle 55.

In the region of the anti-vibration unit 30, the percussion mechanism assembly 10 is connected to the housing unit 90 via an articulated arm 37 such that the percussion mechanism assembly 10 can move along the vibration axis A.

With respect to its movement along the vibration axis A, the movement of the percussion mechanism assembly 10 is limited by a front bump stop 71 and a rear bump stop 73.

According to the invention, the coil spring 35 is in the form of a cylindrically progressive compression spring 36 having two stiffness regions S1, S2 with different levels of stiffness.

In the exemplary embodiment in FIG. 1, the coil spring 35 provided as a cylindrically progressive compression spring 36 is configured in a progressive manner on one side, wherein the stiffness region S2 with the higher stiffness sequentially follows the stiffness region S1 with the lower stiffness.

Figure 2:
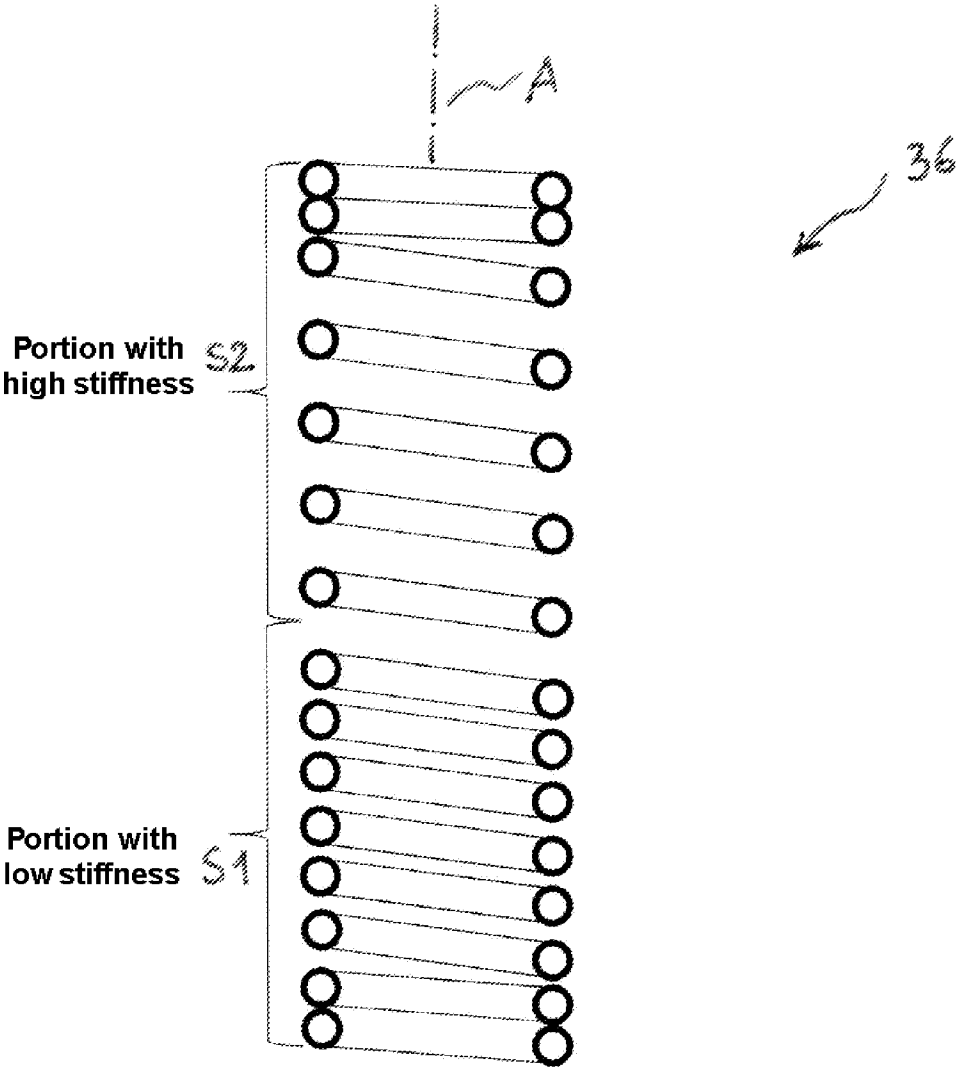
FIG. 2 shows a schematic illustration of the progressive compression spring of the hand-held power tool in FIG. 1.

In FIG. 2, the cylindrically progressive compression spring 36 in FIG. 1 is illustrated in detail. It is readily apparent that the cylindrically progressive compression spring 36 has two stiffness regions S1, S2, which—with respect to the vibration axis—sequentially follow one another. In this case, the two stiffness regions S1, S2 have different levels of stiffness. The first stiffness region S1 has a lower stiffness than the second stiffness region S2.

In the unloaded state, shown in FIG. 2, of the compression spring 36, the two stiffness regions S1, S2 exhibit the same length along the vibration axis A.

Figure 3:
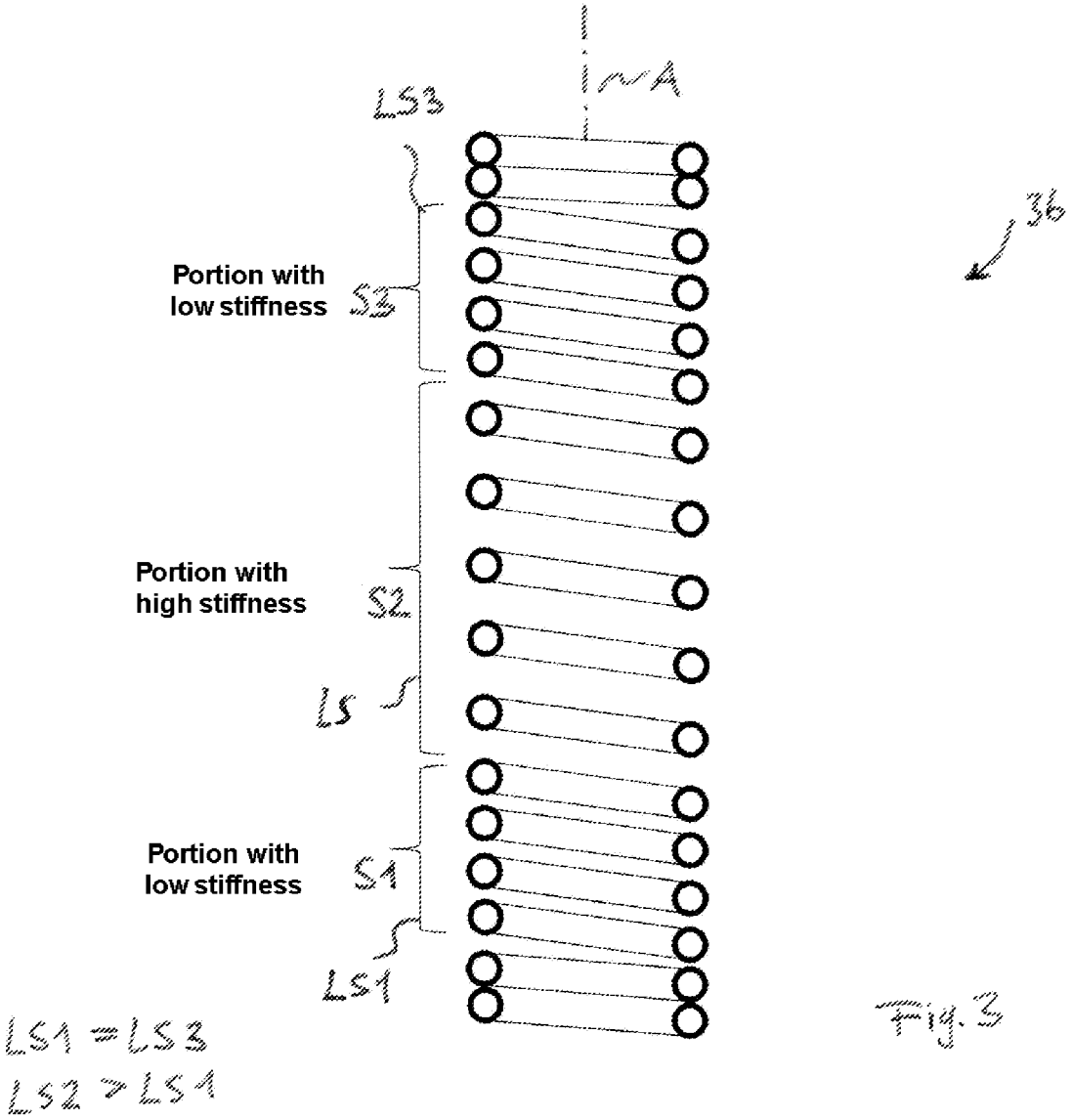
FIG. 3 shows an alternative configuration of a cylindrically progressive compression spring.

A cylindrically progressive compression spring 36 that is configured in a progressive manner on both sides is illustrated in FIG. 3. The compression spring 36 in FIG. 3 has three stiffness regions S1, S2, S3.

In the case of the compression spring 36 in FIG. 3, too, two stiffness regions with different levels of stiffness are formed, specifically the first stiffness region S1 and the second stiffness region S2. The first stiffness region S1 has a lower stiffness than the second stiffness region S2 having a high stiffness.

The third stiffness region S3 has the same stiffness as the first stiffness region S1, and so both the first stiffness region S1 and the second stiffness region S3 each have a lower stiffness than the middle, second stiffness region S2.

It is likewise readily apparent from FIG. 3 that the stiffness region S2 with the higher stiffness is located, along the vibration axis A, between the stiffness regions S1, S2 with the respectively low stiffness.

The stiffness regions S1, S3 with the respectively lower stiffness exhibit the same length LS1, LS3 along the vibration axis A. This has the advantage that the risk of kinking of the cylindrical compression spring 36 configured in a progressive manner on both sides is reduced.

In the exemplary embodiment in FIG. 3, it is likewise the case that, with the compression spring 36 unloaded, the stiffness regions S1, S3 with the respectively low stiffness are shorter along the vibration axis A than a length LS2 of the stiffness region S2 with the higher stiffness. The compression spring 36 has a constant outside diameter.

Figure 4:
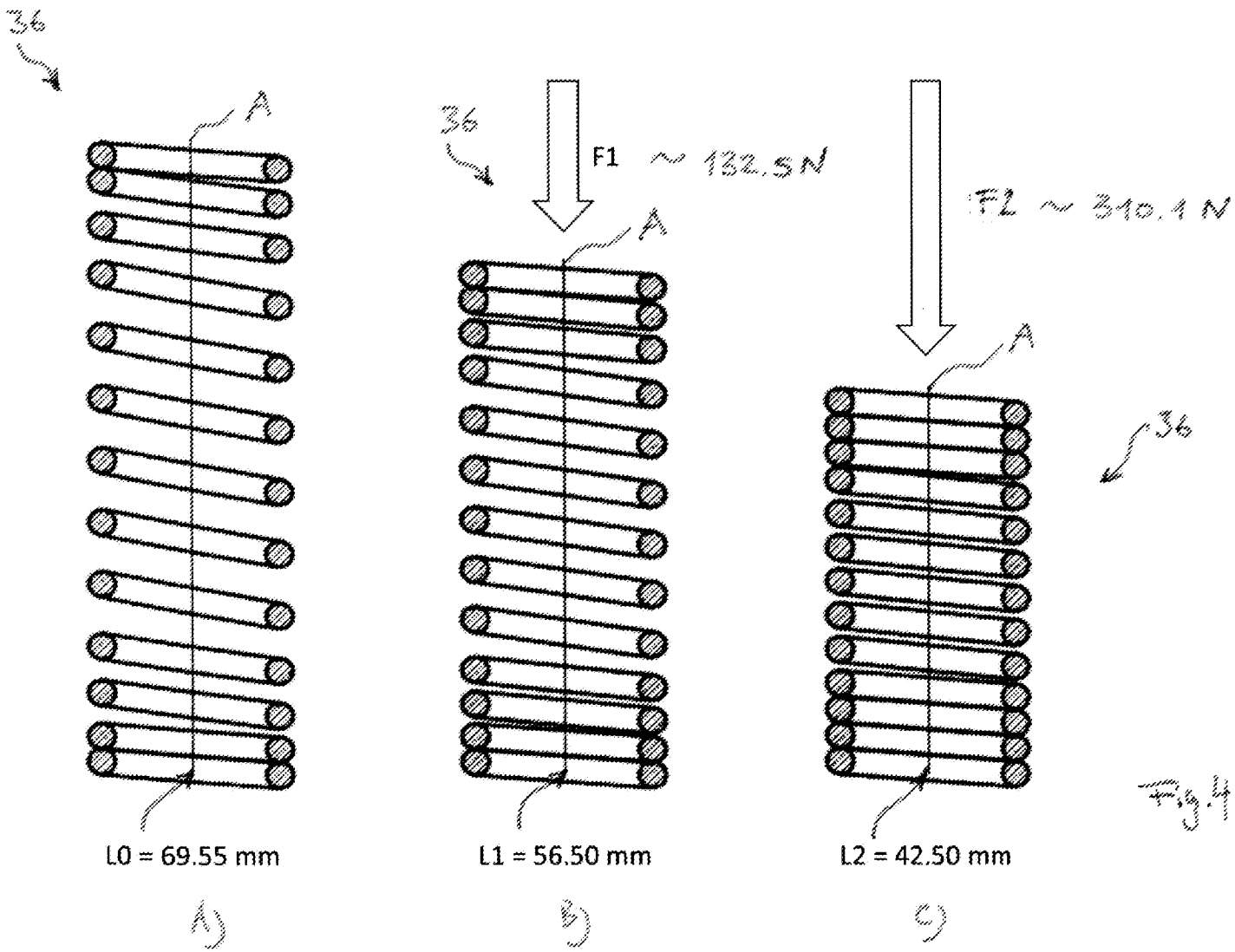
FIG. 4 shows the progressive compression spring in FIG. 3 in different loading states.

With reference to FIG. 4, various states of a preferred structural exemplary embodiment of a compression spring 36 that is progressive on both sides will now be explained. Here, FIG. 4A shows the compression spring 36 in an unloaded state. For example, a nominal length of the compression spring 36 is about 69.55 mm.

FIG. 4B shows the state of the compression spring 36 in an installed and non-actuated state. The nominal length L1 of the unloaded compression spring 36 is about 56.50 mm, and the associated spring force F1 for the non-actuated state is about 132.5 N.

FIG. 4C shows finally the compression spring 36 in an installed and actuated state. The nominal length L2 is in this case about 42.5 mm with an associated spring force F2 of about 310.1 N. FIG. 5 shows further technical characteristics of the particularly preferred compression spring 36 that is progressive on both sides from FIG. 4. The nominal lengths L0, L1, L2, and the spring force F1 associated with the nominal length L1 and the spring force F2 associated with the nominal length L2 have already been described with reference to FIG. 4.

In the case of the structurally preferred compression spring 36, a wire diameter d of 2.8 mm and a mean turn diameter of the compression spring 36 Dm of about 18.2 mm should be noted. The number of spring turns n is calculated to be about 9.9 turns. The total number of turns nt is calculated to be about 13.1 turns.

Figure 6:
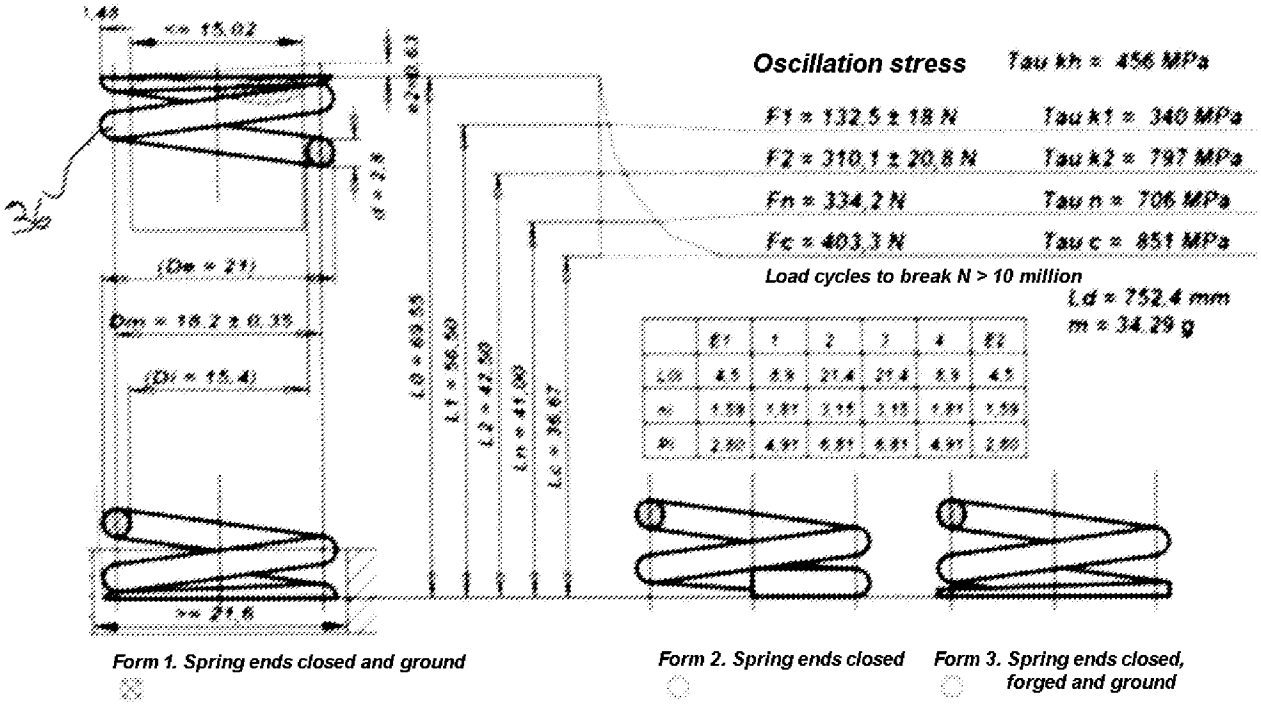
FIG. 6 shows further structural details of the progressive compression spring in FIGS. 3 and 4.

FIG. 6 shows finally a characteristic spring diagram for the preferred cylindrically progressive compression spring 36, which is configured in a progressive manner on both sides and has three stiffness regions. In particular, the relationship between the respective nominal lengths L0, L1, L2 and the associated oscillation stresses F1, F2 etc. are discernible here.

Figure 7:
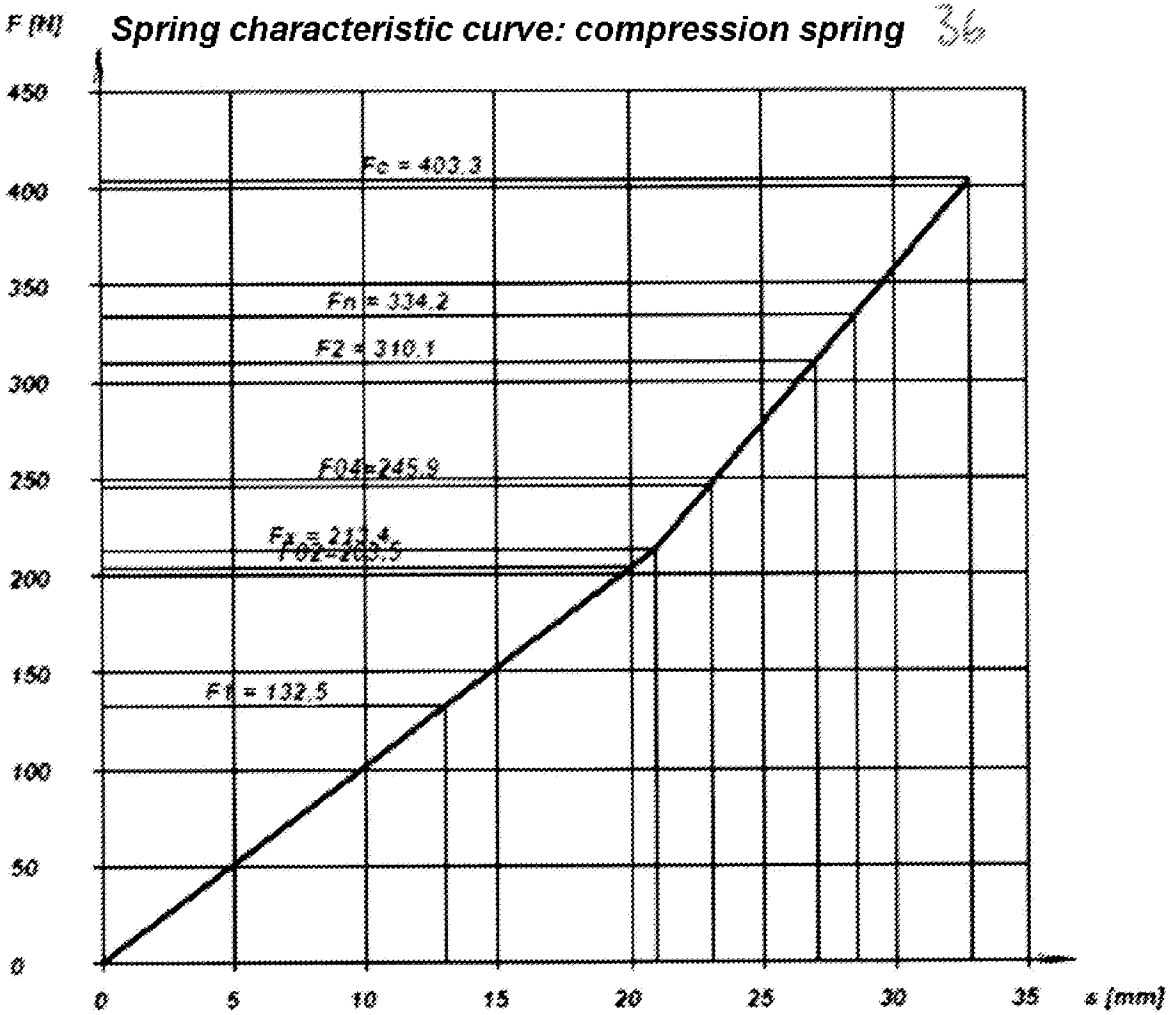
FIG. 7 shows a spring characteristic curve of the progressive compression spring in FIGS. 3 and 4.

FIG. 7 illustrates finally the spring characteristic curve of the preferred compression spring 36 in FIGS. 3 to 6. In this case, an oscillation stress F in N is plotted with respect to the spring travel s in mm. It is readily apparent that the spring characteristic curve rises linearly up to an oscillation stress Fx of about 213.42 N and then kinks from this point (kink of the spring characteristic curve) to a steeper spring characteristic curve portion. The spring characteristic curve of the compression spring 36 thus exhibits a progressive behavior overall.

LIST OF REFERENCE SIGNS

10 Percussion mechanism assembly with motor and transmission
20 Handle assembly
25 Rear handle
30 Anti-vibration unit
35 Coil spring
36 Compression spring
37 Articulated arm
55 Front handle
60 Sliding guide
71 Front bump stop
73 Rear bump stop
90 Housing unit
100 Hand-held power tool
A Vibration axis
L0 Nominal length of the compression spring in an unloaded state
L1 Nominal length of the unloaded in an installed and non-actuated state
L2 Nominal length of the unloaded compression spring in an installed and actuated state
LS1 Length of the first stiffness region
LS2 Length of the second stiffness region
LS3 Length of the third stiffness region
S1 First stiffness region
S2 Second stiffness region
S3 Third stiffness region

What is claimed is:

1. An electric hand-held power tool comprising:

a percussion mechanism assembly vibrating along a vibration axis; and a handle assembly vibrationally decoupled from the percussion mechanism assembly via an anti-vibration unit, wherein the anti-vibration unit has a coil spring oriented along the vibration axis, the coil spring having a plurality of turns, the coil spring being in the form of a cylindrically progressive compression spring having two sides, one connected to the percussion mechanism assembly and the other to the handle assembly, the cylindrically progressive compression spring having a first stiffness region and a second stiffness region with different levels of stiffness; wherein the cylindrically progressive compression spring is configured in a progressive manner on both sides, and has a third stiffness region, the cylindrically progressive compression spring having a constant outer diameter and being made of a constant diameter wire and having a variable pitch so that on an unloaded state, when no load is being applied to the cylindrically progressive compression spring, a first pitch in the first and third stiffness regions is different than a second pitch in the second stiffness region, the cylindrically compressive spring being preloaded and compressed in an installed and non-actuated state to have a nominal installed and non-actuated length smaller than a nominal unloaded length.

2. The hand-held power tool as recited in claim 1 wherein the cylindrically progressive compression spring is configured in a progressive manner on one side, wherein the second stiffness region with a higher stiffness sequentially follows the first stiffness region with a lower stiffness.

3. The hand-held power tool as recited in claim 1 wherein the second stiffness region with a higher stiffness sequentially follows the first stiffness region with a lower stiffness and wherein the third stiffness region has a same stiffness as the first stiffness region.

4. The hand-held power tool as recited in claim 3 wherein the first and third stiffness regions exhibit a same length along the vibration axis.

5. The hand-held power tool as recited in claim 3 wherein, with the cylindrically progressive compression spring unloaded, the first and third stiffness regions are shorter along the vibration axis than a length of the second stiffness region.

6. The hand-held power tool as recited in claim 1 wherein the second stiffness region lies, along the vibration axis, between the first and third stiffness regions, the first and third stiffness regions having lower stiffnesses than the second stiffness region.

7. The hand-held power tool as recited in claim 6 wherein the first and third stiffness regions exhibit a same length along the vibration axis.

8. The hand-held power tool as recited in claim 6 wherein, with the cylindrically progressive compression spring unloaded, the first and third stiffness regions are shorter along the vibration axis than a length of the second stiffness region.

9. The hand-held power tool as recited in claim 1 wherein, with the cylindrically progressive compression spring unloaded, the first and third stiffness regions have a lower stiffness than the second stiffness region and are shorter along the vibration axis than a length of the second stiffness region.

10. A hammer drill comprising the hand-held power tool as recited in claim 1.

11. The hammer drill as recited in claim 10 further comprising a housing, the handle assembly being a rear handle and further comprising a front handle connected to the housing.

12. The hammer drill as recited in claim 11 wherein the percussion mechanism assembly is connected via an articulated arm to the housing.

13. A chipping hammer comprising the hand-held power tool as recited in claim 1.

14. The hand-held power tool as recited in claim 1 further comprising a housing, the percussion mechanism assembly being connected via an articulated arm to the housing.

15. The hand-held power tool as recited in claim 14 wherein the articulated arm and the cylindrically progressive compression spring connect to a same side of the housing.

16. The hand-held power tool as recited in claim 14 further comprising a housing and a rear bump stop and front bump stop connected to the housing limiting movement of the percussion mechanism assembly.

* * * * *